United States Patent [19]

Zakurdaev et al.

[11] 4,263,342

[45] Apr. 21, 1981

[54] METHOD OF MANUFACTURING MERCURY CONTACT ON A BERYLLIUM BASE

[76] Inventors: Anatoly V. Zakurdaev, Proletarsky prospekt, 79, kv. 66; Vladimir I. Vyzhimov, ulitsa Vostrukhina, 6, korpus 2, kv. 48; Vladimir P. Gladkov, Moskvorechie, Studgorodok MIFI, 7, kv. 35; Valery I. Petrov, Simonovsky val, 20, korpus 2, kv. 29, all of Moscow, U.S.S.R.

[21] Appl. No.: 19,748

[22] Filed: Mar. 12, 1979

[51] Int. Cl.[3] ..... B05D 5/12

[52] U.S. Cl. ..... 427/123; 427/328; 148/6.2; 427/436; 428/929; 200/262; 335/58

[58] Field of Search ..... 200/262, 264, 267; 428/929; 148/6.2; 427/123, 436, 328; 204/39, 40; 335/58

[56] References Cited

U.S. PATENT DOCUMENTS

| | | | |
|---|---|---|---|
| 2,311,257 | 2/1943 | Sawyer | 204/39 |
| 2,798,036 | 7/1957 | Utz | 204/40 |
| 3,146,328 | 8/1964 | Mason et al. | 200/263 |
| 3,301,718 | 1/1967 | Morana | 148/6.2 |
| 3,485,682 | 12/1969 | Pearlstein | 148/6.2 |
| 3,558,349 | 1/1971 | Kneppel | 427/436 |
| 3,650,825 | 3/1972 | Lihl | 427/123 |
| 3,827,919 | 8/1974 | Keating | 148/6.2 |

OTHER PUBLICATIONS

Pugatchevitch P.P., "Working with Mercury Under Laboratory and Production Conditions", Nauka Publishers, Moscow, 1972, p. 183.

*Primary Examiner*—John D. Smith

*Attorney, Agent, or Firm*—Lackenbach, Lilling & Siegel

[57] ABSTRACT

The mercury contact comprises a solid metal base of beryllium, wetted with mercury. The method of manufacturing the mercury contact includes periodically dipping the cleaned solid metal base of beryllium into chemically pure mercury through a mixture of saturated water solution of chromic anhydride and a 40 percent solution of hydrofluoric acid water, taken in a 1:1 ratio by volume.

4 Claims, No Drawings

METHOD OF MANUFACTURING MERCURY CONTACT ON A BERYLLIUM BASE

FIELD OF INVENTION

This invention relates to mercury-wetted contacts for electric switching devices and to the technology of their manufacture.

A mercury contact constructed in accordance with the present invention is intended for use as a component of various switching apparatus and devices.

BACKGROUND OF INVENTION

There are widely known mercury or mercury-wetted contacts for switching devices, comprising a solid metal base made of platinum, iron, nickel, or else of metals of the chromium subgroup, viz. tungsten, molybdenum, as well as the methods of manufacture of such contacts, including wetting the cleaned and degreased solid metal base (made of iron and nickel) with mercury by periodic dipping of the base into a mercury-containing liquid medium.

The noble metals acting as the base of the hitherto known mercury contacts are prone to forming intermediate phases and chemical compounds with the mercury, which matter accumulates at the contact junction and eventually affects the electric and dynamic characteristics of the mercury contact, and, hence, its reliability and durability.

The hitherto known mercury contact having iron for its solid metal base is produced by periodically dipping the precoated iron base into a sodium amalgam through either a weak solution of a mineral acid or water.

(See, for instance, "Working With Mercury Under Laboratory And Production Conditions" by P. P. Pugatchevitch, in Russian, NAUKA Publishers, Moscow, 1972, p. 183).

Iron, as well as nickel and the metals of the chromium subgroup practically will not react with mercury. However, these metals are thermodynamically unstable on account of their being electrochemically active. This activity is significantly enhanced by a contact with mercury featuring a high positive potential.

Consequently, the contact junction is not resistant against electrochemical processes resulting in either partial or complete lack of adhesion between the solid metal and mercury. The probability and intensity of these processes are dependent on the quality of the initial wetting of the solid metal with mercury.

The hitherto known method does not provide for adequately wetting the surface of the above mentioned solid metals with mercury, on account of microcavities left in most cases at the contact junction under the mercury film and containing an electrochemically active fluid, e.g. the remains of acid, water and other electrolytes employed by the production process.

These microcavities act as the nuclei of degrading electrochemical processes affecting the stability and durability of the solid metal-mercury contact junction.

It is an object of the present invention to provide a mercury contact wherein the solid metal base is highly electrochemically stable and inert with respect to mercury.

It is also an object of the present invention to provide a method of manufacturing a mercury contact, which should provide for an adequate quality wetting of the surface of the solid metal base with mercury.

This object is attained with a mercury contact wherein, in accordance with the invention, the mercury-wetted solid metal base is made of beryllium.

The object of the invention is further attained in a method of manufacturing a mercury contact, including periodically dipping the cleaned solid metal base of the contact into a liquid medium containing mercury, in which method, in accordance with the present invention, the solid metal base of beryllium is dipped into chemically pure mercury through a mixture containing a saturated solution of chromic anhydride in water and 40 per cent solution of hydrofluoric acid in water, taken in a 1:1 ratio by volume.

The disclosed mercury contact and the method of its manufacture provide for adequate quality of wetting the surface of the solid metal base with mercury (no microcavities are present) and therefore substantially reduces the electrochemical activeness of the solid metal base in the event of engagement with mercury, whereby the stability and durability of the mercury contact are enhanced.

DETAILED DESCRIPTION OF INVENTION

The invention will be further described in connection with an embodiment of the mercury contact and the method of its manufacture.

As the solid metal base of the mercury contact beryllium is used which does not react with mercury. Within a broad range of temperatures (reaching up to as high as several hundred degrees Centigrade) this metal is even less soluble in mercury than iron, nickel, tungsten and molybdenum (on the average, more than by an order of magnitude).

The durability and stability of the beryllium-mercury contact junction (provided, the contact is adequately sealed away in the apropriate atmosphere) is determined solely by the quality of the initial wetting of the beryllium surface with mercury, i.e. by the value of the contact wetting angle $\theta$ calculable from the expression:

$$\cos\theta=(\sigma_1-\sigma_2)/\sigma_3,$$

where $\sigma_1$ is the surface energy at the solid-gas interface;

$\sigma_2$ is the surface energy at the solid-liquid interface;

$\sigma_3$ is the surface energy at the liquid-gas interface.

The value of $\cos\theta$ is the greater, the greater is $\sigma_1$ and the smaller is $\sigma_3$, while the quality of the contact of the mercury film with the surface of the solid metal base depends on the degree of activation of the beryllium surface directly prior to its engagement with mercury.

Once cleaned from oxide films, beryllium features a high surface energy $\sigma_1$ at the solid-gas interface, which enables to obtaining on its surface a mercury film with a small contact wetting angle $\theta$, which film, therefore, is firmly bound by the forces of adhesion to the solid metal base.

The method of manufacturing the mercury contact includes periodically dipping the solid metal base of beryllium into chemically pure mercury through a mixture of a solution of chromic anhydride and a solution of hydrofluoric acid.

The mixture of chromic anhydride and hydrofluoric acid exerts a complex action between beryllium and mercury, and finely cleans and activates their surfaces. The fluorides and chromates of beryllium and mercury, produced by the reactions taking place, exhibit surface-active properties and lowers the surface energy $\sigma_3$ at the mercury-gas interface, thus enhancing the wettability of mercury.

To prepare the mixture, there is preferably used a saturated solution of chromic anhydride in water and a 40 percent solution of hydrofluoric acid in water, the components of the mixture being taken in a 1:1 ratio by volume.

The developing atomic hydrogen exerts a catalytic action upon the wetting process.

The stability of the thus prepared mercury contact is maintained for long periods with the contact being sealed away in relatively low vacuum (about $10^{-1}$ mercury), or else in an atmosphere of commercially available noble gases.

The durability and stability of the contact in its use in mercury-type switching apparatus are maintained owing to no undesirable physical-chemical variations taking place at the contact junction, which otherwise could result in contact failure. For a better understanding of the invention, given hereinbelow are examples of the method of manufacturing a mercury contact.

EXAMPLE 1

A beryllium workpiece of the required shape, its surface degreased in advance in acetone, is dipped several times into chemically pure mercury contained in a vessel under a layer of a mixture of a saturated water solution of chromic anhydride and a 40 percent solution of hydrofluoric acid in water, taken in a 1:1 ratio by volume.

The dipping step is repeated until the beryllium surface is completely wetted with mercury, whereafter the wetted component is flushed in water and in alcohol, and then dried in a vacuum thermostat.

EXAMPLE 2

A beryllium workpiece degreased in advance with an organic solvent is placed into a vessel containing the abovedescribed mixture and mercury, and is then placed in a closed vessel, latter being overturned and slightly shaken.

What we claim is:

1. A method of manufacturing a mercury contact on a beryllium base, comprising immersing said beryllium base into a body of chemically pure liquid mercury covered by a mixture of a solution of chromic anhydride and a solution of hydrofluoric acid.

2. The method of claim 1, wherein the chromic anhydride exists as a saturated solution in water, and the hydrofluoric acid exists as a 40% solution in water, with the components of said mixture existing in a 1:1 ratio by volume.

3. The method of claim 1, wherein the beryllium base is preliminarily degreased with an organic solvent.

4. The method of claim 2, wherein the organic solvent is acetone.

* * * * *